US009062515B2

(12) United States Patent
Borsheim

(10) Patent No.: US 9,062,515 B2
(45) Date of Patent: Jun. 23, 2015

(54) METHOD AND DEVICE FOR SUPPLY OF LIQUIDS FOR KILL AND SCALE TO A SUBSEA WELL

(75) Inventor: Torfinn Borsheim, Sandnes (NO)

(73) Assignee: Subsea Solutions AS, Sandnes (NO)

( * ) Notice: Subject to any disclaimer, the term of this patent is extended or adjusted under 35 U.S.C. 154(b) by 0 days.

(21) Appl. No.: 14/116,717

(22) PCT Filed: May 21, 2012

(86) PCT No.: PCT/NO2012/050093

§ 371 (c)(1),
(2), (4) Date: Dec. 3, 2013

(87) PCT Pub. No.: WO2012/161585

PCT Pub. Date: Nov. 29, 2012

(65) Prior Publication Data

US 2014/0131048 A1 May 15, 2014

(30) Foreign Application Priority Data

May 24, 2011 (NO) ..... 20110765

(51) Int. Cl.
*E21B 37/06* (2006.01)
*E21B 33/035* (2006.01)
(Continued)

(52) U.S. Cl.
CPC ..... *E21B 37/06* (2013.01); *E21B 33/0355* (2013.01); *E21B 34/04* (2013.01); *E21B 41/04* (2013.01); *E21B 41/08* (2013.01)

(58) Field of Classification Search
CPC ..... E21B 33/0355; E21B 37/06; E21B 34/04; E21B 41/04; E21B 41/08
USPC ..... 166/75.13, 351, 344, 368
See application file for complete search history.

(56) References Cited

U.S. PATENT DOCUMENTS 3,552,419 A * 1/1971 Weston, Jr. ..... 137/236.1
3,894,560 A * 7/1975 Baugh ..... 137/606
(Continued)

FOREIGN PATENT DOCUMENTS

WO 2005/047646 A1 5/2005

OTHER PUBLICATIONS

International Search Report for parent application PCT/NO2012/050093, having a mailing date of Jul. 13, 2012.
(Continued)

*Primary Examiner* — James G Sayre
(74) *Attorney, Agent, or Firm* — Andrus Intellectual Property Law, LLP

(57) ABSTRACT

A method and apparatus are for supplying liquids for scale treatment and killing to a subsea well, where the subsea well is provided with a tree which has a swab valve and a coupling for a tree cap. The method comprises: arranging an upgrading module on the tree after the tree cap has been removed, the upgrading module comprises an electric control unit and a tree cap which via an intermediate conduit is coupled to a top valve at the upper portion of the upgrading module, coupling a coupling column comprising at least two column valves and a quick-releasable coupling to the top valve, the coupling column communicates with a vessel via a hose connection; coupling the control unit to the vessel via a signal wire running within or close to the hose connection, thereafter the tree and the upgrading module is controlled via the signal wire; opening the swab valve, the top valve and column valves; and pumping liquid from the vessel via the hose connection, coupling column and upgrading module down into the subsea well.

11 Claims, 4 Drawing Sheets

(51) Int. Cl.

| | |
|---|---|
| ***E21B 34/04*** | (2006.01) |
| ***E21B 41/04*** | (2006.01) |
| ***E21B 41/08*** | (2006.01) |

(56) References Cited

U.S. PATENT DOCUMENTS

| | | | | |
|---|---|---|---|---|
| 4,046,192 | A * | 9/1977 | Darnborough et al. | 166/337 |
| 4,174,000 | A | 11/1979 | Milberger | |
| 5,010,956 | A * | 4/1991 | Bednar | 166/344 |
| 2003/0136927 | A1 | 7/2003 | Baugh | |
| 2009/0293957 | A1 * | 12/2009 | White | 137/1 |
| 2011/0300008 | A1 * | 12/2011 | Fielder et al. | 417/410.3 |

OTHER PUBLICATIONS

Written Opinion for parent application PCT/NO2012/050093, having a mailing date of Jul. 13, 2012.

* cited by examiner

METHOD AND DEVICE FOR SUPPLY OF LIQUIDS FOR KILL AND SCALE TO A SUBSEA WELL

CROSS-REFERENCE TO RELATED APPLICATIONS

This application is the U.S. national stage application of International Application No. PCT/NO2012/050093, filed May 21, 2012, which International application was published on Nov. 29, 2012 as International Publication No. WO 2012/161585 A1 in the English language and which application is incorporated herein by reference. The International application claims priority of Norwegian Patent Application No. 20110765, filed May 24, 2011, which application is incorporated herein by reference.

BACKGROUND

The invention relates to a method for supply of liquid for scale treatment and killing to a subsea well. More particularly it relates to a method for supply of liquids for scale treatment and killing to a subsea well, where the subsea well is provided with a tree which has a swab valve and a coupling for a tree cap. The invention also relates to a device for practicing the method.

During petroleum recovery it has proven necessary to supply liquid to wells in order to treat them, i.e. to prevent the formation of or remove scale. It has also proven necessary to be able to supply heavy liquid to the well for so-called killing.

According to prior art such work is carried out on subsea wells by removing a tree cap from a tree mounted on the subsea well by means of a suitable tool. Then a so-called "kill and scale" tool which has a hose connection to a vessel, is lowered and coupled to the tree, whereupon pumping of liquid into the subsea well may take place.

This prior art has several drawbacks. A considerable drawback is that the tree cap must be removed, which reduces the number of barriers between the well flow and the surroundings.

If a leakage in the valves of a subsea well such as a downhole safety valve is detected, it may be that the only barrier is the swab valve of the tree and the tree cap. Then, due to safety reasons, the tree cap cannot be removed.

The only possibility then is to supply heavy liquid via the production tubing, which implies that neighboring wells must also be shut down.

US-document 2003/0136927 describes a coupling for scale treatment and killing where the coupling is provided with a pressure balanced slide valve in order to avoid potentially large forces which may occur in such couplings.

SUMMARY

The invention has for its object to remedy or reduce at least one of the drawbacks of the prior art.

According to the invention the object is achieved through features which are specified in the description below and in the claims that follow.

There is provided a method for supply of liquids for scale treatment and killing to a subsea well where the subsea well is provided with a tree which has a swab valve and a coupling for a tree cap, and where the method comprises:

arranging an upgrading module on the tree after removal of the tree cap, the upgrading module comprises an electric control unit and a tree cap which via an intermediate conduit is coupled to a top valve at the upper portion of the upgrading module;

coupling a coupling column comprising at least two column valves and a quick-releasable coupling to the valve, as the coupling column communicates with a vessel via a hose connection;

coupling the control unit to the vessel via a signal wire running within or close to the hose connection, as thereafter the well head and the upgrading module is controlled via the signal wire;

opening the swab valve, the top valve and the column valve; and pumping liquid from the vessel via the hose, coupling column and upgrading module down into the subsea well.

The upgrading module may be arranged on the tree at an earlier time. It is typically used to overcome weaknesses in existing equipment, and may also comprise high pressure hydraulic pumps and valves, low pressure hydraulic pumps and valves and other useful equipment such as chemical pumps and valves.

Together with the swab valve the top valve constitutes two barriers. The coupling column may be coupled to the top valve without first having to remove a tree cap. The integrity of the subsea valve is therefore maintained during coupling of the coupling column even if the other valves of the subsea valve have failed or leak.

The method may at drift of the vessel from the subsea well comprise:

ending the pumping down of liquid;

closing the swab valve, the top valve and the column valves;

uncoupling the signal wire from the control unit; and uncoupling the coupling column from the upgrading module in the quick-releasable coupling.

The coupling column may thereby in a fast way temporarily be uncoupled from the upgrading module.

At completed operation the method typically comprises:

ending the pumping down of liquid;

closing the swab valve, top valve and the column valves;

uncoupling the signal wire from the control unit; and uncoupling the coupling columns from the upgrading module at the top valve.

The top valve is well suited for mounting of a combined lid and lifting lug when it is closed.

The method may be practiced by means of an apparatus for supply of liquids for scale treatment and killing to a subsea well where the well is provided with a valve tree which has a swab valve and a coupling for a tree cap, and where the apparatus is characterized in that an upgrading module is arranged on the tree, the upgrading module comprises an electric control unit and a tree cap which via an intermediate conduit is coupled to a top valve at the upper portion of the upgrading module, and where a coupling column comprising at least two column valves and a quick-releasable coupling can be coupled to the top valve, and where the coupling column is communicatively coupled to a vessel via a hose connection, and where the control unit can be coupled to the vessel via a signal wire running within or close to the hose connection, after coupling the well head and the upgrading module can be controlled via the signal wire.

The quick-releasable coupling may comprise a releasable portion which can be coupled to the top valve, the releasable coupling is arranged to be able to release at unforeseen events.

The high-pressure pump and corresponding components may be replaced by a pressure riser which e.g. is supplied with fluid from a low-pressure system.

At least one of the column valves may be a check valve, a hydraulically controlled valve or an ROV-operable valve (ROV: remotely operated vehicle).

Moreover this applies to valves in general. Some operators prefer ROV-operable valves, while others prefer actuator-operated valves, where e.g. hydraulics is used.

Thus the method and the apparatus according to the invention solves some relatively serious weaknesses of subsea wells operated according to prior art.

BRIEF DESCRIPTION OF THE DRAWINGS

In what follows an example of a preferred method and embodiment is described, which is visualized in the accompanying drawings, where.

DETAILED DESCRIPTION OF THE DRAWINGS

Figure 1:
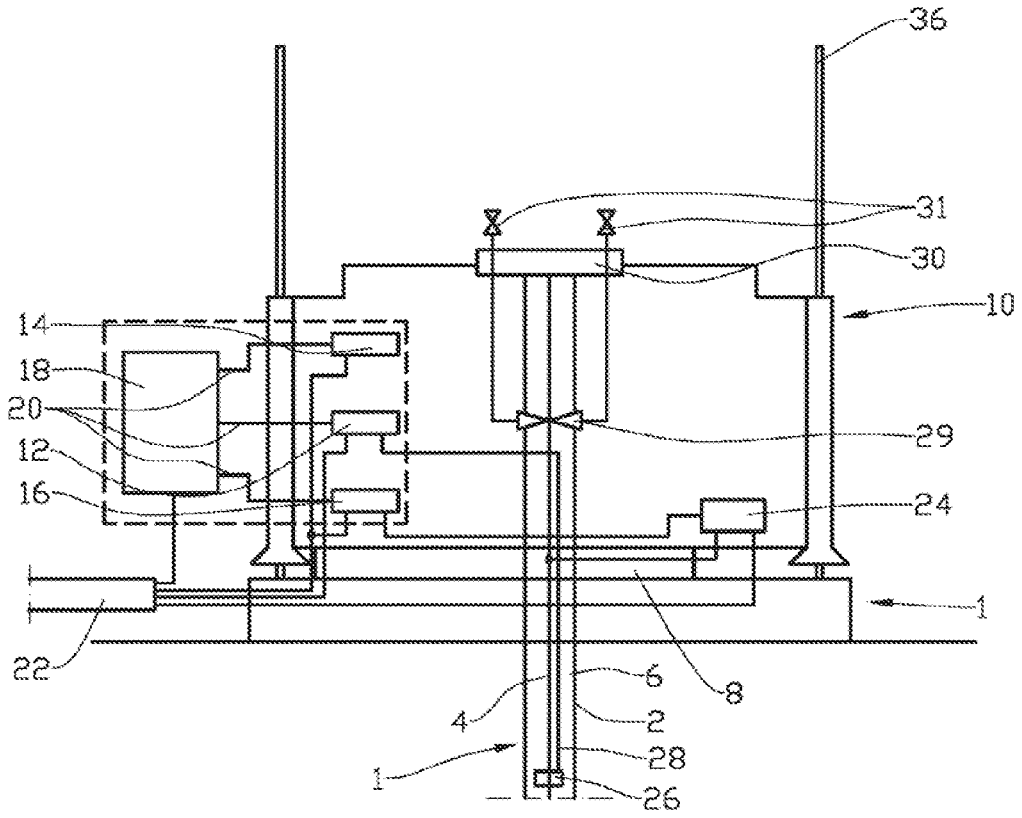
FIG. 1 schematically illustrates a subsea well with tree according to prior art.

In the drawings reference numeral 1 designates a subsea well with an outer tubular 2 e.g. formed by a casing, and a production tubing 4, where an annulus 6 is formed between the outer tubular 2 and the production tubing 4.

The production tubing 4 is suspended from a production tubing head 8, and a tree 10 is arranged on the production tubing head 8.

The tree 10 is provided with a high-pressure hydraulic valve package 12, a low-pressure hydraulic valve package 14 and a chemical valve package 16.

The various valve packages 12, 14, 16 are controlled from a control module 18 located on or at the tree 10 via control lines 20. The valve packages 12, 14, 16 and the control module 18 are often formed by a mounting which in the figures is indicated by means of a dashed rectangle.

The valve packages 12, 14, 16 are supplied liquid in a per se known way via an umbilical 22 running to a not-illustrated installation on the surface, and which also supplies the control module 18 with electric power and control signals, and a chemical valve 24 with chemicals.

The high-pressure hydraulic valve package 12 is coupled to a downhole safety valve 26 by means of a safety valve conduit 28. The low-pressure hydraulic valve package 14 is coupled to other not-illustrated valves and actuators of the tree 10.

A swab valve 29 is in a per se known way controlled via ROV-operated valves 31.

The tree 10 is provided with a tree cap 30 and additionally comprises a large number of not-illustrated components known to a man skilled in the art.

Figure 2:
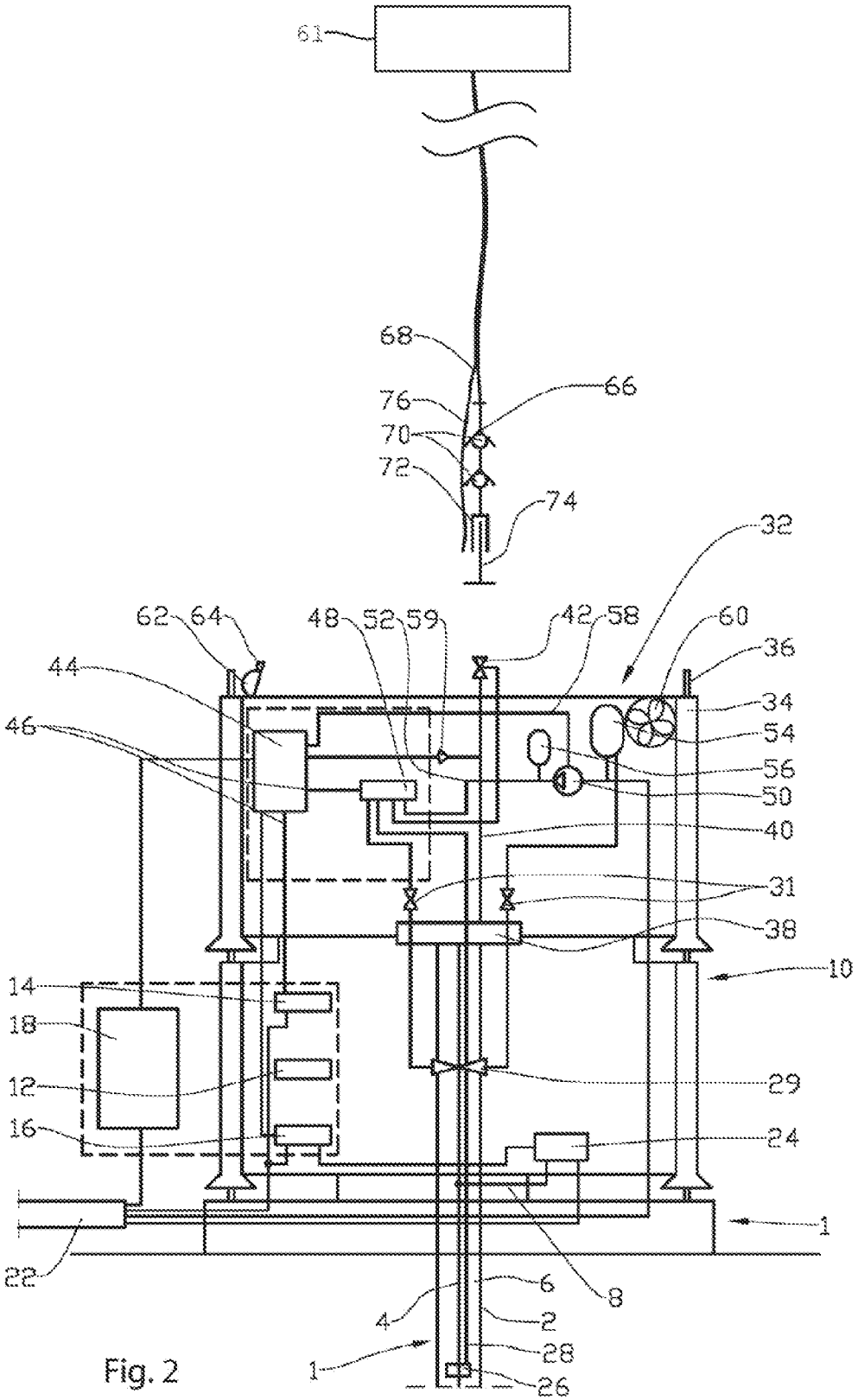
FIG. 2 schematically illustrates an upgrading module according to the invention, where the upgrading module is located on the tree and where a coupling column is ready to be mounted to the upgrading module.
Figure 3:
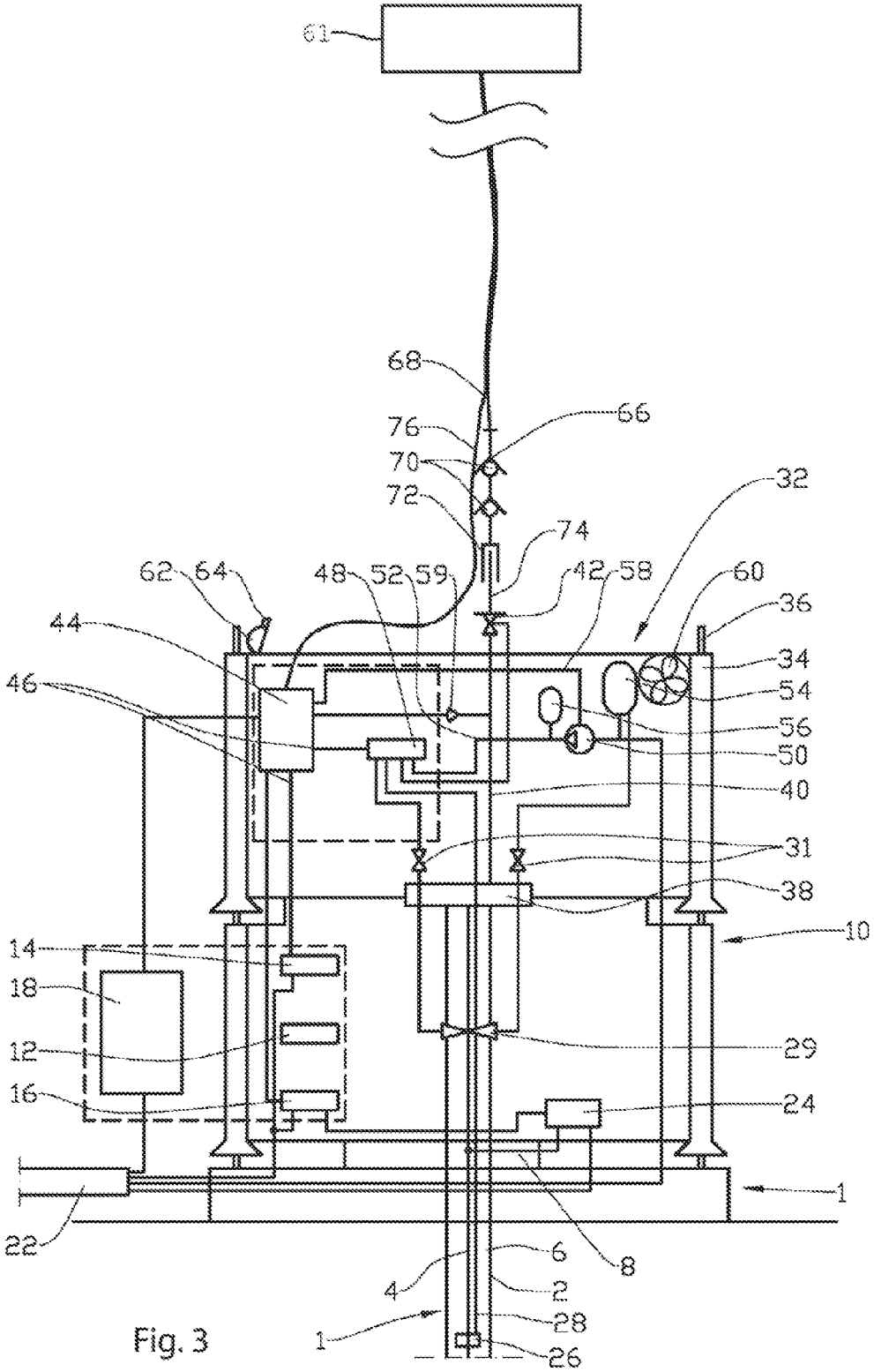
FIG. 3 schematically illustrates the upgrading module in FIG. 2 when the coupling column is coupled to the upgrading module.

Reference is now made to FIG. 2. An upgrading module 32 is arranged on the tree 10 by means of guides 34 which fit on guide posts 36 of the well 1. The upgrading module 32 is provided with an embedded tree cap 38 which complementary fits on the tree 10 and which has the same functions as the tree cap 30, but which in addition is provided with an intermediate conduit 40 with a top valve 42 for liquids which are used to remove scale and for killing. The top valve 42 may be ROV-controlled, but is in FIG. 2 illustrated as a hydraulically actuated valve.

The upgrading module 32 is provided with a control unit 44, the control unit 44 is directly or via the control module 18 coupled to the not-illustrated installation on the surface via the umbilical 22. The control unit 44 controls the various valve packages 12, 14, 16 via control lines 46.

The upgrading module 32 is in this illustrated embodiment provided with a second high-pressure hydraulic valve package 48 controlled from the control unit 44 via the control line 46. The high-pressure hydraulic valve package 12 is uncoupled.

A high-pressure pump 50 is located in the upgrading module 32 and is provided with hydraulic liquid with reduced pressure via the umbilical 22. The high-pressure pump 50 is coupled to the second high-pressure hydraulic valve package 48 by means of a high-pressure conduit 52. A reservoir 54 is coupled to the inlet-side of the high-pressure pump 50, while an accumulator 56 is coupled to the outlet-side of the high-pressure pump 50. The high-pressure pump 50 is controlled from the control unit 44 via a control wire 58.

Figure 4:
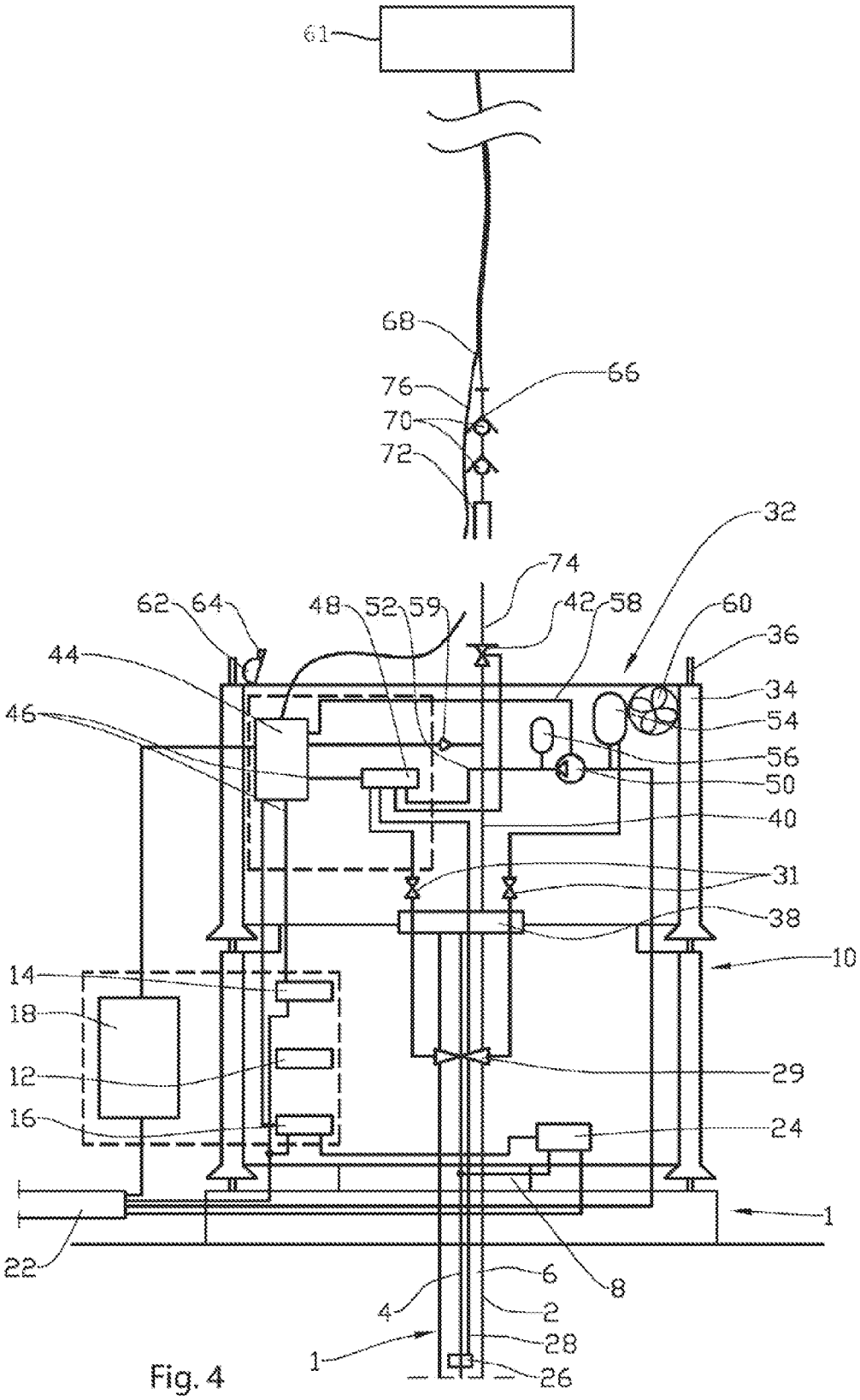
FIG. 4 schematically illustrates a coupling column temporarily uncoupled from the upgrading module.

The swab valve 29 is hydraulically controlled via the ROV-operated valves 31. FIG. 4 illustrates that it is controlled from the high-pressure hydraulic valve package 48, but depending on valve type it might as well be controlled by a low-pressure hydraulic valve package. The swab valve is drained to the reservoir 54 via the ROV-valve 31. A pressure sensor 59 is coupled to the intermediate conduit 40 and sends measuring signals to the control unit 44. The pressure sensor 59 is particularly useful to see if underlying valves, e.g. the swab valve 29, leaks.

Per se necessary valves which are not required to explain the invention is not illustrated, since a man skilled in the art will know their purpose and function.

The upgrading module 32 comprises in this preferred embodiment also a thruster 60, a light 62 and a camera 64.

A tubular coupling column 66 is connected to a vessel 61 by means of a hose connection 68. The coupling column 66 is due to safety reasons provided with two column valves 70, here formed by check valves which allow flow directed from the vessel to the subsea well 1.

At a level, in operation, below the column valves 70 the coupling column is provided with a quick-releasable coupling 72. The quick-releasable coupling 72, of a per se known design, comprises a lower releasable portion 74 which complementary fits to the top valve 42.

A signal wire 76 which can be coupled to the control unit 44 runs from the not-illustrated vessel within or close to the hose connection 68 and to the coupling column 66.

When the upgrading module 32 shall be installed, the original tree cap 30 is removed by means of suitable not-illustrated tooling. The upgrading module 32 is hoisted down to the tree 10, whereupon the upgrading module 32 remotely controlled by means of the thruster 60, the light source 62 and the camera 64, is positioned in such a way that the guides 34 correspond with the guide posts 36. Alternatively a mini-submarine can be used for the positioning operation.

After the upgrading module 32 has been put down on the tree 10, the tree cap 38 is coupled to the tree 10. In this illustrated embodiment including a high-pressure pump 50, the supply to the high-pressure pump 50 is coupled to the high-pressure conduit of the umbilical 22, and the outlet from the high-pressure pump 50 is coupled to the other high-pressure hydraulic valve package 48. The electric power and control cables of the umbilical 22 is coupled to the control unit 44, and control lines 46 between the control unit 44 and valves in the hydraulic valve packages 14, 16, 48 not already connected, are connected.

The control unit 44 has thus during operation taken over at least the control functions of the control module 18, while the high-pressure conduit of the umbilical 22 may work at a considerably reduced pressure.

When there is a need for treatment of scale or to kill the well 1, the coupling column 66 is lowered down towards the upgrading module 32, see FIG. 2. Then the releasable portion 74 is coupled to a top valve 42 and the signal wire 76 is coupled to the control unit 44, which then changes operational mode from production mode where the control unit 44 is controlled via the umbilical 22 from the not-illustrated installation on the surface, to so-called "kill and scale" mode where the control unit 44 is controlled from the not-illustrated vessel.

The tree 10 and the upgrading module 32 are now controlled from the not-illustrated vessel, and liquid may be pumped from the not-illustrated vessel and down into the subsea well 1 after the swab valve 29, the top valve 42 and the column valves 70 have been opened.

If the not-illustrated vessel should drift from the subsea well 1 and the signal wire 76 is torn or uncoupled from the control unit 44, closing of the downhole safety valve 26, the swab valve 29, the top valve 42 and the column valves 70 is commenced. The quick-releasable coupling 72 is released, see FIG. 4.

When the conditions are normalized, the coupling column 66 is recoupled to the releasable portion 74, the signal wire 76 is recoupled to the control unit 44, and the work is resumed.

When the work is carried out, the coupling column 66 is uncoupled from the upgrading module 32 in reverse order of the first coupling. The control unit 44 then again assumes production mode.

The invention claimed is:

1. A method for supply of liquids for scale treatment and killing to a subsea well, the subsea well is provided with a tree which has a swab valve and a coupling for a tree cap, the method comprising:

arranging an upgrading module on the tree, wherein the upgrading module comprises a tree cap which via an intermediate conduit is coupled to a top valve at an upper portion of the upgrading module, coupling a coupling column comprising at least two column valves and a quick-releasable coupling to the top valve, wherein the coupling column communicates with a vessel via a hose connection;

controlling at least the upgrading module or the tree from the vessel;

opening the swab valve, the top valve and the column valves; and pumping liquid from the vessel via the hose connection, coupling column and upgrading module down into the subsea well.

2. The method in accordance with claim 1, further comprising arranging an upgrading module on the tree after an existing tree cap has been removed.

3. The method in accordance with claim 1, further comprising providing the upgrading module with an electric control unit, and coupling the control unit to the vessel via a signal wire running within or close to the hose connection, wherein at least the tree or the upgrading module is thereafter controlled via the signal wire.

4. The method in accordance with claim 3, wherein the method at drift of the vessel from the subsea well further comprises:

ending the pumping down of liquid;

closing the swab valve, the top valve and column valves;

uncoupling the signal wire from the control unit; and uncoupling the coupling column from the upgrading module in the quick-releasable coupling.

5. The method in accordance with claim 3, further comprising:

ending the pumping down of liquid;

closing the swab valve, the top valve and column valves;

uncoupling the signal wire from the control unit; and uncoupling the coupling column from the upgrading module at the top valve.

6. An apparatus for supply of liquids for scale treatment and killing to a subsea well, wherein the subsea well is provided with a tree which has a swab valve and a coupling for a tree cap, comprising an upgrading module arranged on the tree, the upgrading module comprising a tree cap which via an intermediate conduit is coupled to a top valve at an upper portion of the upgrading module, and where a coupling column comprising at least two column valves and a quick-releasable coupling can be coupled to the top valve, and where the coupling column is communicatively coupled to a vessel via a hose connection, after coupling at least the tree or the upgrading module can be controlled.

7. The apparatus in accordance with claim 6, the upgrading module comprising an electric control unit and where the control unit can be coupled to the vessel via a signal wire running within or close to the hose connection, after coupling at least the tree or the upgrading module can be controlled via the signal wire.

8. The apparatus in accordance with claim 6, the quick-releasable coupling comprising a releasable portion which can be coupled to the top valve, wherein the releasable coupling is arranged to be able to release at unforeseen events.

9. The apparatus in accordance with claim 6, wherein at least one of the column valves is a check valve.

10. The apparatus in accordance with claim 6, wherein at least one of the column valves is a hydraulically controlled valve.

11. The apparatus in accordance with claim 6, wherein at least one of the column valves is an ROV-operated valve.

* * * * *